US005964385A

United States Patent [19]

Simon

[11] Patent Number: 5,964,385

[45] Date of Patent: Oct. 12, 1999

[54] CANE RETRIEVAL DEVICE

[76] Inventor: William H. Simon, 1313 Partridge La., Villanova, Pa. 19085

[21] Appl. No.: 09/044,534

[22] Filed: Mar. 19, 1998

[51] Int. Cl.[6] ..... B65H 75/48; A45F 5/00

[52] U.S. Cl. ..... 224/162; 224/219; 242/404.1; 242/588.1; 242/375; 242/378.4; 135/66

[58] Field of Search ..... 224/162, 219, 224/220, 221, 222, 267; 242/404.1, 345, 588.1, 405, 385, 385.4, 375, 378.4; 135/65, 66; 119/796, 865

[56] References Cited

U.S. PATENT DOCUMENTS

| | | | |
|---|---|---|---|
| 1,069,593 | 8/1913 | Weaver et al. | 242/375 |
| 1,577,272 | 3/1926 | Treadaway | 242/404.1 X |
| 2,222,409 | 11/1940 | Gottlieb | 119/796 |
| 2,759,685 | 8/1956 | Flippen | 242/375 |
| 2,776,644 | 1/1957 | Fontaine | 242/385.4 X |
| 2,793,617 | 5/1957 | Palmer | 224/162 |
| 3,060,929 | 10/1962 | Zivi | 602/32 |
| 3,233,591 | 2/1966 | Rogers et al. | 242/385.4 X |
| 3,705,697 | 12/1972 | Chagnon | 242/404.1 |
| 3,812,588 | 5/1974 | Bennett | 242/405 X |
| 4,215,829 | 8/1980 | Boyllin | 242/375 |
| 4,427,163 | 1/1984 | Kondziola | 242/378.4 X |
| 4,483,330 | 11/1984 | Jacobsen et al. | 242/378.4 X |
| 4,884,730 | 12/1989 | Carpenter . | |
| 4,958,758 | 9/1990 | Tipple . | |
| 5,031,576 | 7/1991 | Weinberg | 119/865 |
| 5,130,899 | 7/1992 | Larkin et al. | 224/219 X |
| 5,246,183 | 9/1993 | Leyden | 242/375 |
| 5,388,877 | 2/1995 | Wenk | 224/162 X |
| 5,540,468 | 7/1996 | Fassman | 224/162 X |

*Primary Examiner*—Gregory M. Vidovich
*Attorney, Agent, or Firm*—McHale & Slavin PA

[57] ABSTRACT

A cane retrieval device includes a flexible linking member that retractably joins a cane to a wrist-mounted attachment strap. A constant, tension-spring controlled positioning assembly allows placement of a tethered cane in a user-selected location remote from the user's hands, while drawing the cane into a readily grasped orientation in a uniform manner upon demand. A brake mechanism prevents unwanted cane retraction. The wrist-mounted attachment strap is adjustable and requires no special dexterity during securement or removal.

3 Claims, 3 Drawing Sheets

CANE RETRIEVAL DEVICE

FIELD OF THE INVENTION

This invention is directed to mobility aids and, in particular, to a wrist-mounted cane retrieval device.

BACKGROUND OF THE INVENTION

Walking canes are well-known support devices used to assist individuals while walking or standing. Canes may even be used to ease the transition between standing and sitting. A problem with canes occurs during non-use and when dropped.

Since canes are used to increase mobility, all manner of destinations may be reached by cane users. After arriving at a chosen destination, many cane users will need to store their cane in a location where it will remain until needed. Storage may be temporary such as while writing a check or for a longer period of time such as while watching a movie. Unfortunately, many destinations, such as theaters, do not provide readily-available cane storage locations. As a result, individuals may have to store the cane in an inappropriate, or even dangerous, location while not in use. Retrieval of a dropped cane is also difficult. In fact, the act of stooping to pick up a fallen cane is simply beyond the dexterity level of many cane users.

One approach to making cane use more convenient involves attaching the cane to a leash that keeps the cane near an individual's wrist if dropped or released. For instance, U.S. Pat. No. 4,159,792 discloses a device to keep a cane in position for ready use, but it interferes with free use of the tethered hand. Tasks such as check and letter writing or book reading are difficult with a cane dangling from one's wrist.

Other devices have been designed in an attempt to keep a cane nearby. These devices typically involve a cord attached via a swivel, or other connection, to a wrist strap. U.S. Pat. No. 4,958,758 provides an example of this type of device. Although this device includes an intermediate-length cord and may provide free hand use, they often do so at the expense of placing canes in locations that cause an interference with other objection while the "free" hand is in use.

Still other devices have utilized different methods of making cane use more convenient. For example, U.S. Pat. No. 4,884,730, employs a belt-mounted, retractable leash. This device utilizes a spring-loaded pulley that draws the cane toward a user's trunk when the cane is released. Although this type of device may leave hands unencumbered the device constantly pulls the cane toward a user's waist. As a result, users of the '730 device are locked in a perpetual tug-of-war that tends to urge the cane into a non-stable orientation. What's more, the force required to extend the chain increases as more line is drawn out.

Thus, what is needed is a cane retrieval device that allows a cane to be temporarily rested in a location remote from an individual's hands, while delivering the cane into a readily-grasped orientation when desired. The device should not interfere with user cadence, and should retrieve a cane in a controlled manner, at a uniform pace regardless of cane location. The device should also not require any special skills during attachment and removal.

SUMMARY OF THE INVENTION

The instant invention is a cane retrieval device that allows a cane to be placed in a location remote from an individual's hands, while facilitating controlled cane retrieval as desired.

The device includes a flexible linking member that retractably joins a cane to a wrist-mounted attachment. A positioning assembly advantageously allows placement of a tethered cane into a user-selected location, yet provides controlled cane retrieval when desired.

Thus, it is an object of the instant invention to provide a cane retrieval device that allows a cane to be temporarily rested in a location remote from an individual's hands, while delivering the cane into a readily-grasped orientation when desired.

It is a further object of the instant invention to provide a cane retrieval device that does not interfere with the stance or stride of a cane user.

It is yet another object of the instant invention to provide a cane retrieval device that retrieves a cane in a controlled manner, at a uniform acceleration regardless of cane location.

It is also an object of the instant invention to provide a cane retrieval device that does not require any tools for attachment or removal of the device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
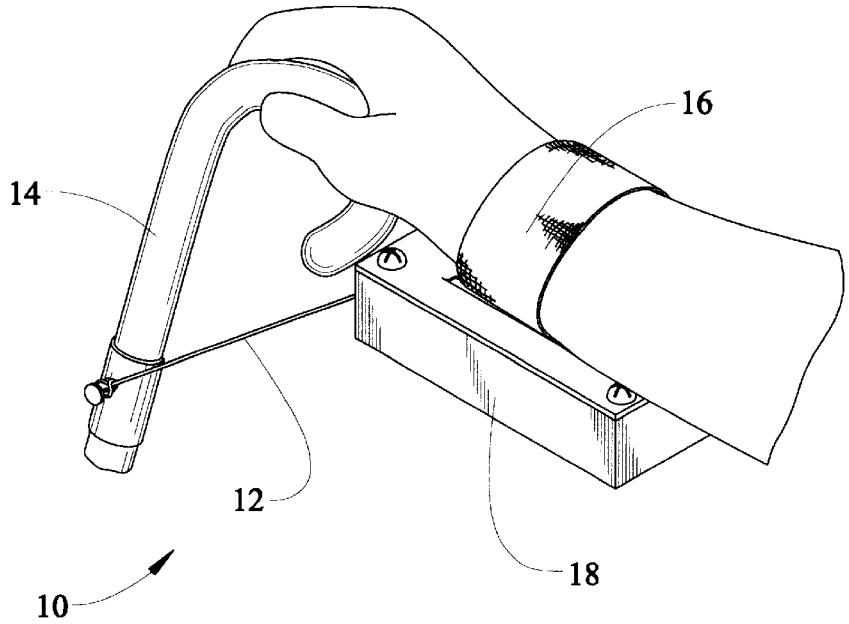
FIG. 1 is a pictorial view of a cane retrieval device according to the present invention, shown bringing a cane into an easily-grasped location.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with respect to FIG. 1, the cane retrieval device 10 of the present invention is shown in use. By way of overview, the device 10 includes a flexible linking member 12 that retractably joins a cane 14 to a wrist-mounted attachment strap 16. A positioning assembly 18 draws the cane 14 towards the attachment strap 16, but allows the distance between the tethered cane 14 and the attachment strap 16 to be increased as needed. Details of the invention will be discussed below.

Figure 3:
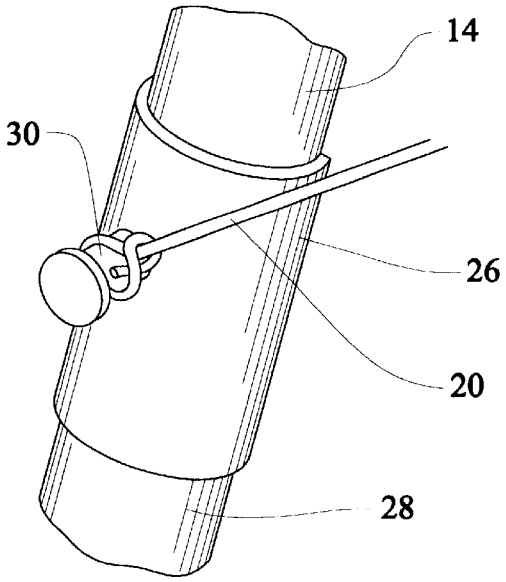
FIG. 3 is a close-up view of the connection between the cane and the flexible linking member.
Figure 5:
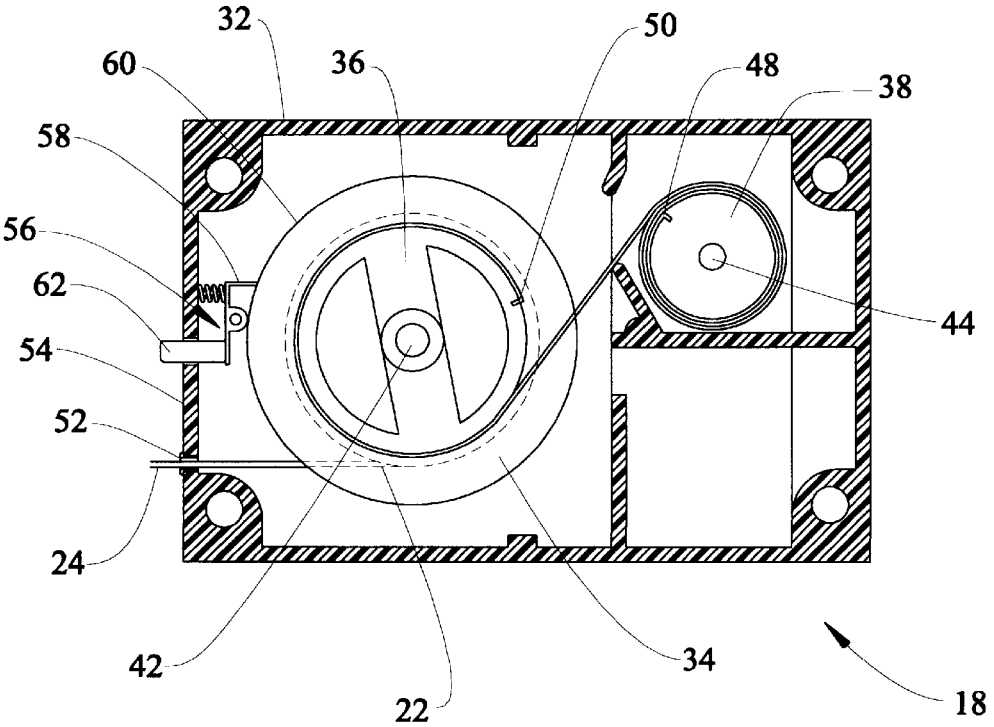
FIG. 5 is a top plan view of the positioning assembly of FIG. 4.

With additional reference to FIGS. 3 and 5, the linking member or cable 12 is essentially a cord of fixed length fashioned from woven steel or other similar material. The cable 12 is colored red for improved visibility. The cable 12 is characterized by a first end 20 and a second end 22 separated by a middle portion 24. An anchoring panel 26 is attached to an outer surface 28 of the cane 14, and the cable first end 20 is, in turn, attached to a post 30 that extends orthogonally from the panel. As described below, the cable second end 22, and a variable amount of the cable middle portion 24, are secured within the positioning assembly 18.

Figure 4:
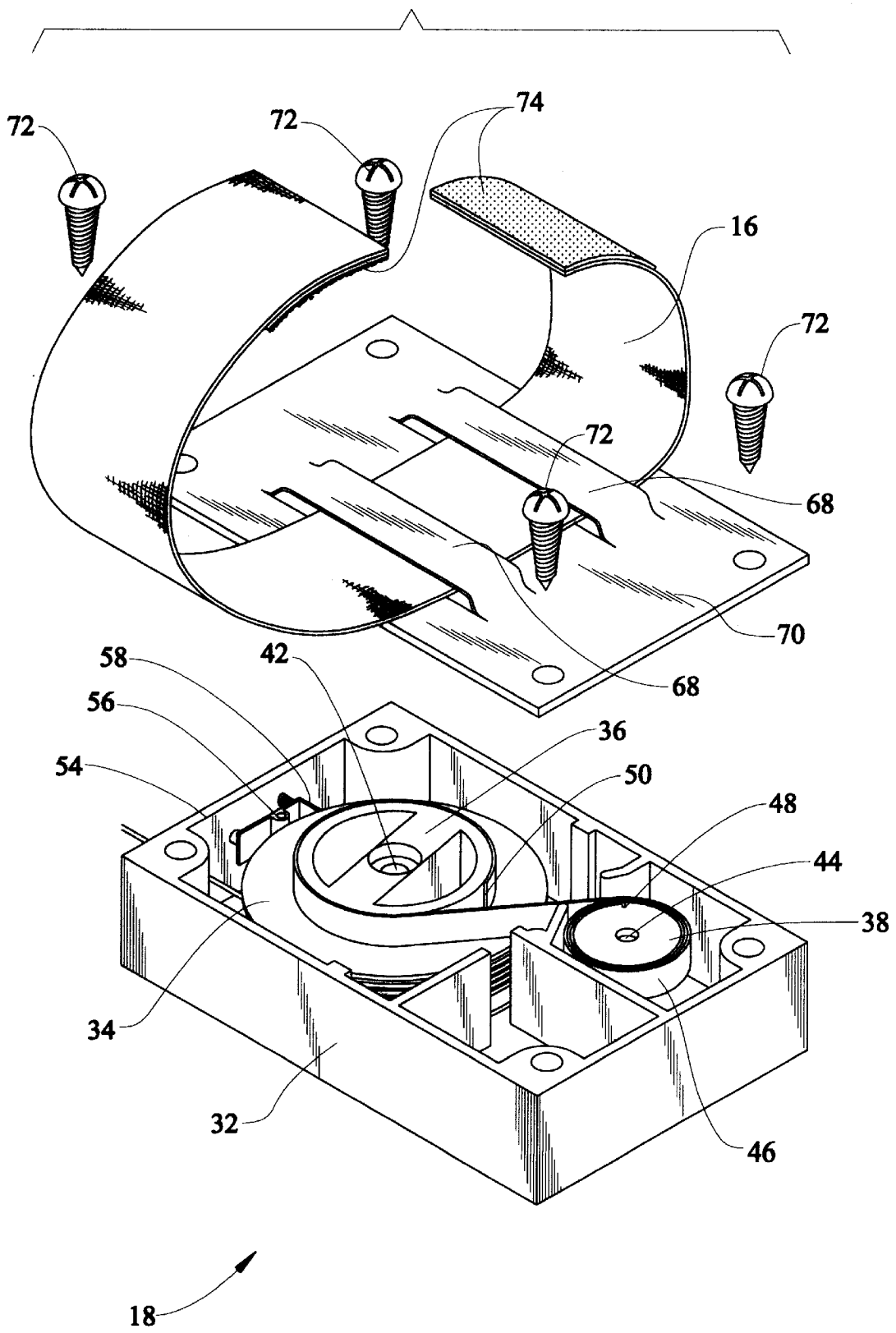
FIG. 4 is an exploded perspective view of the device of FIG. 1, with the positioning assembly shown in detail.

As seen in FIGS. 4 and 5, the positioning assembly 18 includes an essentially-hollow housing shell 32 that encloses a storage spool 34, a take-up reel 36, and a source reel 38. The storage spool 34 and the reels 36,38 are rotatably mounted on axles 42,44 disposed within the housing shell 32. More particularly, the storage spool 34 and the take-up reel 36 share a first axle 42 and rotate as a unit. The source reel 38 is mounted on a second axle 44 spaced apart from, yet parallel to, the first axle 42.

The source reel 38 and take-up reel 36 are connected by a constant-force winding spring 46. The winding spring 46 has a first end 48 attached to the source reel 38 and a second end 50 attached to the take-up reel 36. The winding spring 46 is wrapped in different directions around the source reel 38 and the take-up reel 36. As a result, when the spring 46 unwinds off the source reel 38 it winds onto the take-up reel 36, and vice versa.

The winding spring 46 has a permanent curvature that urges the winding spring to coil around the source reel 38. In its equilibrium state, the winding spring 46 is wrapped around the source reel 38.

Although the winding spring 46 is biased to coil around the source reel 38, pulling the cable first end 20 with a predetermined amount of force will overcome the coiling bias. In the preferred embodiment, the required force is approximately one-and-one-half pounds. Additionally, because the first end 48 of the winding spring 46 is attached to a rotating source reel 38, rather than a fixed point, the force needed to draw out cable 12 remains consistent throughout cable travel. The cane 14 does not become more difficult to move as it travels further from the housing shell 32. The cable 12 extends through cable aperture 52 disposed within the housing shell front wall 54.

As shown most clearly in FIG. 5, the positioning assembly 18 also includes a brake mechanism 56 that prevents uncontrolled retraction of the cable 12 and attached cane 14. A preferred embodiment of the brake mechanism 56 includes a spring-loaded stopping ram 58 that pivotally engages an outer flange 60 of the storage spool 34. The storage spool 34, take-up reel 36, and source reel 38 will only rotate in the outgoing direction while the stopping ram 58 is engaging the outer flange 60. An integrated release button 62, when pressed, disengages the brake mechanism 56, spacing the stopping ram 58 away from the outer flange 60. Pressing the release button 62 frees the storage spool 34 and reels 36,38 to rotate in both directions.

Figure 2:
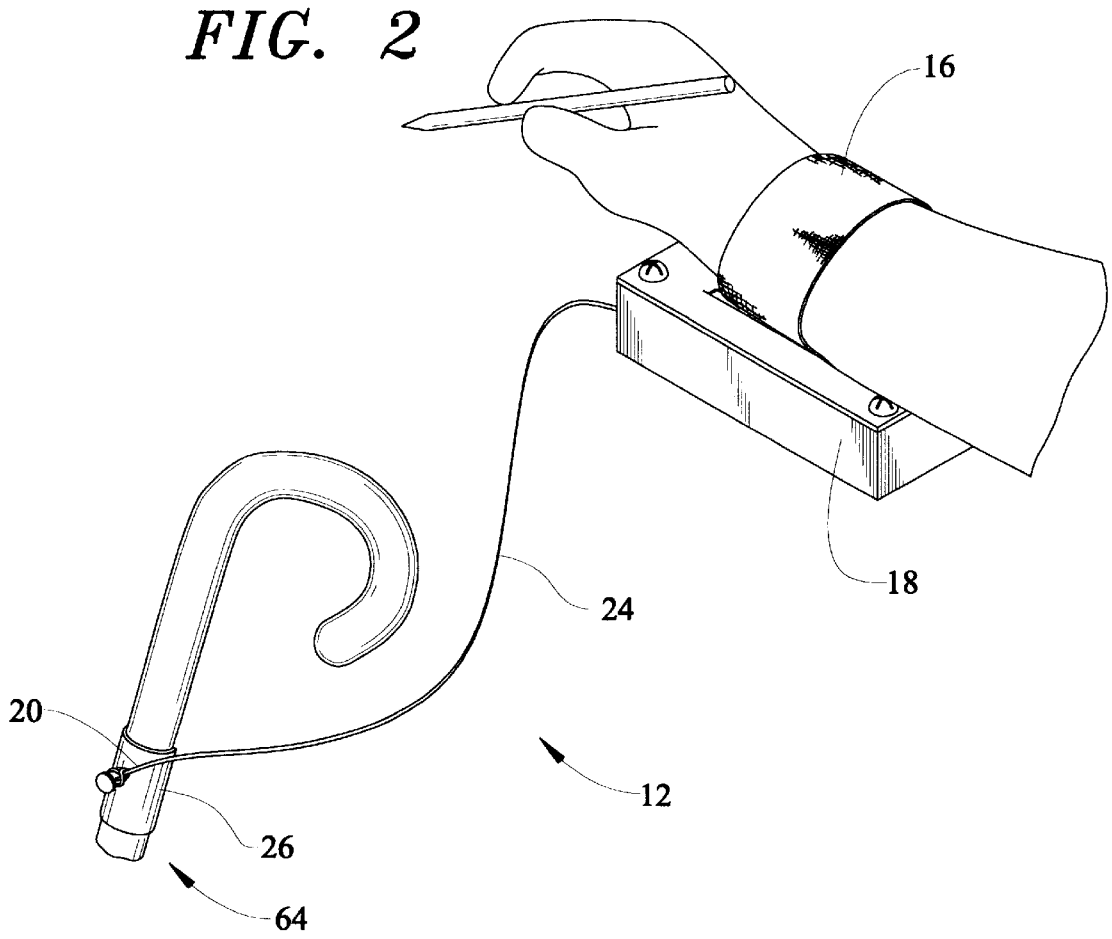
FIG. 2 is a pictorial view of the cane retrieval device of FIG. 1, shown maintaining a cane in a remote location during hand use.

As shown in FIG. 2, the cane retrieval device 10 of the present invention allows a cane 14 to be placed, as desired, in an orientation 64 remote from the user's hands. When the individual wishes to use the cane 14, he or she simply pushes the release button 62 to disengage the brake mechanism 56. While the brake mechanism 56 is disengaged, the above-mentioned camber in the winding spring 46 produces cooperative motion between the reels 36,38 and the storage spool 34. More specifically, the spring 46 winds off of the take-up reel 36, coiling back onto the source reel 38. This winding spring motion also draws the cable 12 back into the housing shell 32 and winds the cable onto the storage spool 34.

Through this arrangement, the present invention advantageously allows an individual to free both hands as needed, while still maintaining control of a cane 14. When attached to the present invention, a cane 14 may be put down at will and retrieved with ease. Additionally, the consistent-force nature of the winding spring 46, beneficially retracts the cable 12 at a uniform acceleration. As a result, the present device will retrieve an attached cane 10 in a manner that is safe and controlled, regardless of cane location.

With reference to FIG. 4, the wrist strap 16 is flexible and secured to a top wall 70 of the housing shell 32. The wrist strap 16 passes through a series of loops 68 integrated into the top wall 70, and the top wall 70 is fastened with screws 72 to the balance of the housing shell 32. The wrist strap 16 includes corresponding patches of hook-and-loop-type fastening material 74, like that commonly sold under the trademark "VELCRO". Although other types of fasteners may be used, hook-and-loop-type fastening material 74 is preferred. Hook-and-loop-type fastening material 74 promotes adjustability and does not require specialized movements to accomplish attachment or removal.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. In combination with a cane, a cane retrieval device for retrieving said cane at a consistent acceleration, said device comprising:

a flexible linking member having a first end spaced apart from a second end by a middle portion, said first end being attached to said cane;

a positioning assembly for guiding said first end of said flexible linking member into a preferred location with respect to an individual's hand, said first end being urged into said preferred location with a consistent tension of predetermined magnitude; said positioning assembly including a winding spring having a first end and a second end, said first end attached to a rotating first reel, said second end being attached to a rotating second reel, said winding spring being wound in a first direction around said first reel and in a second direction around said second reel, said second direction being opposite said first direction; said first reel being operatively associated with said second reel via said winding spring; said flexible linking member being operatively associated with said second reel; and an attachment strap disposed on said positioning assembly, said attachment strap being adapted to encircle a wrist of said individual for securing said positioning assembly against said wrist of said individual;

whereby said operative association of said first reel and said second reel results in constant-acceleration motion of said cane attached to said flexible linking member first end from a remote location to a proximal location, regardless of the distance between said remote location and said proximal location; and whereby said attached cane moves at a consistent acceleration in response to a release of potential energy stored within said winding spring.

2. In combination with a cane, a cane retrieval device for retrieving said cane at a consistent acceleration, said device comprising:

a flexible linking member having a first end spaced apart from a second end by a middle portion, said first end being attached to said cane;

a positioning assembly for guiding said first end of said flexible linking member into a preferred location with respect to an individual's hand, said positioning assembly including a winding spring having a first end and a second end, said first end attached to a rotating first reel, said second end being attached to a rotating second reel, said winding spring being wound in a first direction around said first reel and in a second direction around said second reel, said second direction being opposite said first direction; said first reel being operatively associated with said second reel via said winding spring; said flexible linking member being operatively associated with said second reel;

a brake mechanism constructed and arranged to prevent rotating movement of said second reel when said brake mechanism is in an engaged position; and an attachment strap disposed on said positioning assembly, said attachment strap being adapted to encircle a wrist of said individual for securing said positioning assembly against said wrist of said individual;

whereby said cane is attached to said flexible linking member first end for selective placement in a remote location, and whereby said operative association of said first reel and said second reel results in motion of said cane from said remote location into a proximal location with a consistent acceleration regardless of the distance between said remote location and said proximal location; and whereby said attached cane moves at a consistent acceleration in response to a release of potential energy stored within said winding spring.

3. In combination with a cane, a cane retrieval device for retrieving said cane at a consistent acceleration, said device comprising:

a flexible linking member having a first end spaced apart from a second end by a middle portion;

an anchoring panel affixed to said linking member first end, said anchoring panel adapted for selective attachment to said cane;

a positioning assembly for guiding said first end of said flexible linking member into a preferred location with respect to an individual's hand, said positioning assembly including a winding spring having a first end and a second end, said first end attached to a rotating first reel, said second end being attached to a rotating second reel, said winding spring being wound in a first direction around said first reel and in a second direction around said second reel, said second direction being opposite said first direction; said first reel being operatively associated with said second reel via said winding spring; said flexible linking member being operatively associated with said second reel;

a brake mechanism constructed and arranged to prevent rotating movement of said second reel when said brake mechanism is in an engaged position; and an attachment strap disposed on said positioning assembly, said attachment strap being adapted to encircle a wrist of said individual for securing said positioning assembly against said wrist of said individual;

whereby said cane is attached to said linking member for selective placement in a remote location, and whereby said operative association of said first reel and said second reel results in motion of said cane from said remote location into a proximal location with a consistent acceleration regardless of the distance between said remote location and said proximal location; and whereby said attached cane moves at a consistent acceleration in response to a release of potential energy from within said winding spring.

* * * * *